United States Patent [19]

Ho

[11] Patent Number: 4,848,144

[45] Date of Patent: Jul. 18, 1989

[54] METHOD OF PREDICTING THE TORQUE AND DRAG IN DIRECTIONAL WELLS

[75] Inventor: Hwa-Shan Ho, Spring, Tex.

[73] Assignee: NL Sperry-Sun, Inc., Houston, Tex.

[21] Appl. No.: 253,075

[22] Filed: Oct. 3, 1988

[51] Int. Cl.[4] ..... E21B 47/00

[52] U.S. Cl. ..... 73/151; 175/45; 175/61

[58] Field of Search ..... 73/151, 151.5; 175/40, 175/45, 61; 364/422

[56] References Cited

U.S. PATENT DOCUMENTS

| | | | |
|---|---|---|---|
| 4,384,483 | 5/1983 | Dellinger et al. | 73/151 |
| 4,549,431 | 10/1985 | Soellnah | 175/45 |
| 4,643,264 | 2/1987 | Dellinger | 175/61 |
| 4,715,452 | 12/1987 | Sheppard | 175/61 |
| 4,760,735 | 8/1988 | Sheppard et al. | 73/151 |

OTHER PUBLICATIONS

IADC/SPE Paper #11380 Torque and Drag in Directional Wells Prediction and Measurement by C. A. Johancsik et al.

SPE Paper #15463 Designing Well Paths to Reduce Drag and Torque by M. C. Sheppard et al.

SPE Paper #16663 Field Comparison of 2-D and 3-D Methods for the Borehole Friction Evaluation in Directional Wells by E. E Maidla et al.

SPE Paper #16664 Uses and Limitations of a Drillstring Tension and Torque Model to Monitor Hole Conditions by J. F. Brett et al.

SPE Paper #15562 General Formulation of Drillstring Under Large Deformation and Its Use in BHA Analysis by H.-S. Ho.

SPE Paper #16658 Prediction of Drilling Trajectory in Directional Wells via a New Rock-Bit Interaction Model by H.-S. Ho.

SPE Paper #18047 An Improved Modeling Program for Computing the Torque and Drag in Directional and Deep Wells by H.-S. Ho.

*Primary Examiner*—Stewart J. Levy

*Assistant Examiner*—Kevin D. O'Shea

*Attorney, Agent, or Firm*—Browning, Bushman, Zamecki & Anderson

[57] ABSTRACT

A method is provided for generating an improved torque-drag model for at least the collar portion of the drill string in a directional oil or gas well. The technique of the present invention determine the stiffness of incremental portions of the drill string, and uses this information, the borehole clearance, and the borehole trajectory to determine the contact locations between the drill string and the sidewalls of the well. The contact force at these determined locations can be calculated, taking into consideration all significant kinematic, external, and internal forces acting on that incremental portion of the drill string. More acurate torque-drag analysis provided by the improved model of the present invention assists in well planning, prediction, and control, assists in avoiding drilling problems, and reduces total costs for the well.

38 Claims, 4 Drawing Sheets

METHOD OF PREDICTING THE TORQUE AND DRAG IN DIRECTIONAL WELLS

BACKGROUND OF THE INVENTION

1. Field of the Invention

The present invention relates to methods of predicting the torque and/or drag on a drill string in a directional oil and gas well. More particularly, the present invention relates to improved methods for more accurately predicting and/or analyzing the measured torque and drag of a drill string in such a well to better plan, predict, and control borehole trajectory, to avoid or predict drilling troubles, and to reduce the total cost for the entire well.

2. Description of the Background

As oil and gas exploration becomes more expensive due to more severe environments, there is an increasing urgency to reduce the total drilling, completion, and production cost of a well in order to develop a reservoir more economically. Directional drilling is increasingly being regarded as an effective means to minimize overall development and production cost of an oil field, particularly for the following situations: (1) Drilling multiple directional wells from the same platform or rigsite, particularly in offshore and arctic areas, to reduce rig cost; and (2) Drilling "horizontal" wells to improve production drainage, avoid water coning, and develop very thin reservoirs. While the outlook on directional drilling is very positive, there are many technical problems that need to be resolved in order to further reduce the total cost of a directional well. One such problem concerns the accurate prediction and interpretation of drill string torque and drag data.

Computer models have been used for years to predict drill string torque and drag. The predicted data may be compared to actual or measured torque and drag data, respectively obtained from portable rotary torque meters and weight indicators placed below the kelly and travelling equipment.

Drill string torque and drag data has heretofore been input to a torque drag model, and its findings used for improved well planning design to reduce torque and drag, and for more realistic drill string design and surface equipment selection. On a more limited basis, prior art torque and drag models have been used for rig-site trouble-spotting using diagnostic drilling (tripping) logs by comparing measured and predicted torque and drag to spot potential troubles, and for an aid in casing running and setting. U.S. Pat. No. 4,715,452 discloses a drilling technique intended to reduce the drag and torque loss in the drill string system.

The current drill string torque/drag models, which are widely used in the drilling industry, are each variations of a "soft string" model, i.e. a model that considers the entire length of the drill string sufficiently soft so that the stiffness of the drill string is not taken into consideration. More particularly, the "soft string" torque and drag model: (1) Assumes the drill string to continuously contact the borehole. This implies that effectively the borehole clearance is zero (or rather, no effect of actual borehole clearance is seen); (2) Ignores the presence of shear forces in the drill string in its force equilibrium. Under general conditions, the assumption of zero stiffness does not imply vanishing shears; and (3) For an infinitesimal drill string element, violates moment equilibrium in the lateral direction. For any finite drill string segment, the assumed torque transfer is incorrect.

Since the soft-string model ignores the effects of drill string stiffness, stabilizer placement, and borehole clearance, it generally shows reduced sensitivity to local borehole crookedness and underestimates the torque and drag. Examples of soft string torque and drag models are discussed in the following publications: (1) Johancsik, C. A., Dawson, R. and Friesen, D. B.: "Torque and Drag in Directional Wells—Prediction and Measurement", LADC/SPE conf., SPE paper #11380, New Orleans, 1983, pp. 201–208; (2) Sheppard, M. C., Wick, C. and Burgess, T. M.: "Designing Well Paths to Reduce Drag and Torque", SPE paper #15463, Presented at SPE Conf., October 1986, New Orleans, p. 12; (3) Maidla, E. E. and Wojtanowicz, A. K.: "Field Comparison of 2-D and 3-D Methods for the Borehole Friction Evaluation in Directional Wells", SPE paper #16663, Presented at SPE Conf., September 1987, Dallas, pp. 125–139, Drilling; and (4) Brett, J. F., Beckett, C. A. and Smith, D. L.: "Uses and Limitations of a Drill string Tension and Torque Model to Monitor Hole Conditions", SPE paper #16664, Presented at SPE Conf., September 1987, Dallas, pp. 125–139, Drilling. These references disclose the use of the torque and drag model to plan the directional well path for reduced torque and drag, to estimate the maximum drill string load in order to help in the design of the drill string, and/or to infer borehole quality from the difference between downhole weight on bit (WOB) and surface WOB.

As noted above, each of the softstring models neglects the stiffness of the drill string, and is independent of the clearance between the drill string and the borehole wall. As a result, effects of tight holes and severe local hole crookednesses cannot be easily detected by such a model. The soft-string model thus generally underestimates the torque and drag, or overestimates the friction coefficient. Accordingly, the usefulness of the soft-string model as a rigsite monitor/advisory tool for trouble-spotting is severly limited.

In view of these limitations, some companies have reportedly incorporated a stiffness correction factor to the soft-string model. While this correction factor, when used, will increase the torque and drag for the model to more closely approach the actual measured torque and drag, it does not provide a reliable model for torque and drag predictions to play a major role in well planning, drilling operation (trouble diagnosis and prevention), casing running/setting operations, and completion/cementing operations.

The disadvantages of the prior art are overcome by the present invention, and improved methods and techniques are hereafter disclosed which provide a more reliable and more meaningful torque and drag model which may be used to reliably predict torque and/or drag, and thereby more successfully and economically drill and complete a directional oil or gas well.

SUMMARY OF THE INVENTION

The actual torque and drag on a drill string is the result of the incremental torque and drag along the three primary sections of a typical drill string: the conventional-wall drill pipe section, the heavy-wall drill pipe section, and the collar section or bottom hole assembly of the drill string. As the name suggests, the heavy wall drill pipe section comprises lengths of heavy wall drill pipe (HWDP). The collar section comprises one or more interconnected lengths of a much heavier walled tubular, generally referred to as the collar. Typically, the collar section is provided between the heavy wall drill pipe section and the drill bit to minimize the likelihood of buckling, and hence may be referred to as the bottom hole assembly when at this location. The collar section may, however, be provided at a higher location along the drill string and not adjacent the bit.

An improved torque and drag program is presented here that combines a bottomhole assembly (BHA) analysis in at least the collar section of the drill string. According to a preferred embodiment, this BHA analysis is coupled with a soft-string model analysis for the remainder of the drill string, i.e. both the drill pipe and HWDP sections. The rationale of the improved torque and drag model is to include the effect of drill string stiffness where such effect is the greatest, namely in the collar. Adding BHA analysis also enables one to include the effects of stabilizer placement and hole clearance. In addition, when used for castings with centralizers, the output of the BHA analysis portion will enable one to determine the amount of eccentricity of the casing. This information is important for proper cementing operation.

The improved torque and drag model of the present invention more reliably enables one to make better selection of drill string design, perform better rigsite trouble-spotting, and aid in casing running and setting. In addition, the model as disclosed herein may be used for the following additional purposes: (a) inferring downhole loads (WOB, TOB, or casing landing force) from surface measurements; (b) quantifying the casing eccentricity and its effect on cementing, using a program that computes the actual deformation of the near-bottom section of the casing; (c) aid in depth correlation of MWD measurements; (d) aid in jarring operation by identifying the free point and the overpull needed to activate jarring, since both are affected by drag; and (e) redefine borehole trajectory and geometric condition, e.g. by using successive (time lapsed) tripping logs and the improved torque and drag model, one can detect changes in the trajectory and/or geometric conditions of the borehole.

It is an object of the present invention to provide an improved torque and/or drag model which yields a more realistic torque and/drag computation.

It is another object of the invention to provide an improved torque and/or drag analysis for a drill string which considers drill string stiffness for at least a portion of the drill string.

Still another object of the invention is a torque and/or drag model which determines location and magnitude of the contact forces acting on a portion of the drill string as a function of the trajectory of the well.

It is a feature of the present invention to provide a torque/drag model which determines torque and/or drag on a drill string as a function of the placement of stabilizers on the drill string and as a function of borehole clearance between the drill string and the well.

Still another feature of the present invention is a torque/drag analysis which calculates the kinematics, external forces, and internal forces on at least a portion of the drill string.

As a further feature of the present invention, a torque and/or drag analysis may be performed on the conventional and heavy wall drill pipe portions of the drill string using soft string analysis, and combining the soft string analysis with a bottomhole analysis for the collar portion of the drill string.

An advantage of the present invention is that the improved torque and drag model may be more reliably used to predict and control the path of a directional well, avoid, predict, or advise the drilling operator of potential troubles, and minimize the total cost of the well by optimizing conflicting governing parameters.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
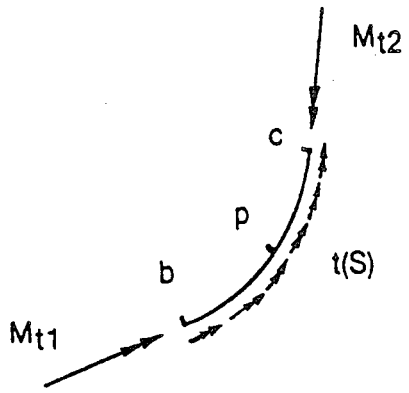
FIG. 1 is a free body diagram of the torsional moments acting on a portion of a drill string subjected to torque at both ends.

In order to obtain a better understanding of the assumptions of the soft-string torque and drag model, and of the benefits of the improved model according to the present invention, the basic governing equations for each model are provided below. For these equations, the following nomenclature is used:

$A_i$: Drill string section area defined by inner diameter $D_i$ $A_o$: Drill string section area defined by outer diameter $D_o$ $A_d$: Deviation angle $A_z$: Azimuth angle E: Elastic (Young's) modulus $(\vec{E}_1,\vec{E}_2,\vec{E}_3)$: Unit base vectors in global system, pointing in East, North, and Up-vertical directions $(\vec{E}_n,\vec{E}_b,\vec{E}_T)$: Unit base vector in natural curvilinear system $\vec{E}_n$: Principal normal direction $\vec{E}_b$: Binormal direction $\vec{E}_t$: Tangential direction, positive uphole $\vec{F}$: Resultant force vector at section of drill string f: Friction coefficient $f_c$: Distributed contact force vector on drill string $(F_1,F_2,F_3)$: Components of resultant vector force F at a section in global coordinates g $\vec{E}_g$: Vector of submerged drill string weight per unit length:

$g=g_v(A_o-A_i)$ $g_v=g_s-g_f$; submerged weight density $g_s$: Drill string's dry weight density $g_f$: Fluid's weight density I: Moment of inertia of drill string section $=(Do^4-Di^4)/64$ $k_b$: Total bending curvature $k_n$: Natural tortuosity of drill string centerline
$k_z$: Rate of change of azimuth angle: $dA_z/dS$
$\vec{M}$: Resultant moment vector at a positive section of BHA
$\vec{N}$: Distributed normal contact force, $=N_nE_n+\vec{N}_b\vec{E}_b$
$M_t$: Drill string torque
$(O,M_b,-M_t)$: Components of $\vec{M}$ in curvilinear coordinates
$p_o$: Annulus fluid pressure
$p_i$: Bore fluid pressure
r(S): Torque-generating radius of drill string
S: Arc length of borehole/drill string centerline, positive going uphole
T: Actual axial tension
$T_e$: Effective axial tension, $=T+(p_oA_o-p_iA_i)$
$T_o$: Sticking force (effective)
t: Distributed torque per unit length on drill string
$t_p$: Over-pull factor, =Surface tension induced by $T_o$, divided by $T_o$
$t_d$: Drag factor=Total surface tension ($T_o=0$) divided by total suspended string weight
$t_m$: Torque factor=Surface torque divided by torque on a straight hole of same constant deviation angle, $A_d$
$(V_n,V_b,T)$: Physical components of resultant force $\vec{F}$ in curvilinear coordinates
(X, Y, Z): Fixed global coordinate system in: East, North, and Up-vertical directions Derivation of Soft-String Model in Natural Coordinates The basic governing equations are given below in natural curvilinear coordinates for the soft-string model.

The effects of the internal and external fluids, with pressures $p_i$ and $p_o$, are taken into consideration by using the effective tension, $T_e$:

$$T_e=T+p_oA_o-p_iA_i \tag{1}$$

and replacing the dry weight density, $g_s$, by the submerged density, $g_v$:

$$g_v=g_s-g_f, \tag{2}$$

where $g_f$ is the fluid density.

With those substitutions, equilibrium of the soft-string model is described as follows (while tripping out):

$$d(T\vec{E}_t)/dS+\vec{N}-f\,N\,\vec{E}_t+g\,\vec{E}_g=0. \tag{3}$$

Using the Frenet-Serret formulas for the centerline of the borehole:

$$d\,\vec{E}_t/dS=k_b\vec{E}_n; \tag{4}$$

$$d\,\vec{E}_n/dS=-k_b\vec{E}_t+k_n\vec{E}_b; \tag{5}$$

where $k_b$ is the total flexural curvature and $k_n$ the natural tortuosity of the hole centerline, one can express the base vectors $\vec{E}_t$ and $\vec{E}_n$ in terms of the deviation (or inclination) and azimuth angles, $A_d$ and $A_z$ as follows:

$$\vec{E}_t = -\sin A_d \sin A_z\,\vec{E}_1 - \sin A_d \cos A_z\,\vec{E}_2 + \cos A_d\,\vec{E}_3; \tag{6}$$

$$k_b\,\vec{E}_n = -\vec{E}_1\,(dA_d/dS\,\cos A_d \sin A_z + dA_z/dS\,\sin A_d \cos A_z) - \vec{E}_2\,(dA_d/dS\,\cos A_d \sin A_z + dA_z/dS\,\sin A_d \cos A_z) - \vec{E}b_3\,(dA_d/dS\,\sin A_d); \tag{7}$$

-continued $$k_b^2 = (dA_d/dS)^2 + (dA_z/dS)^2\,(\sin A_d)^2\,;\ kb > 0.$$

Therefore:

$$\vec{E}_g * \vec{E}_t = -\vec{E}_3 * \vec{E}t = \cos Ad: \tag{8}$$

$$\vec{E}_g * \vec{E}_n = (dA_d/dS)\sin A_d/k_b;$$

$$\vec{E}_g * \vec{E}_b = -(dA_z/dS)\,(\sin A_d)^2/k_b.$$

Separating the distributed lateral contact force N into two components:

$$\vec{N}=N_n\vec{E}_n+N_b\vec{E}_b; \tag{9}$$

one obtains $$dT/dS-fN+g\vec{E}_g*\vec{E}_t=0; \tag{10}$$

$$N_n=-(TK_b+g\vec{E}_g*\vec{E}_n); \tag{11}$$

$$N_b=-g\vec{E}_g*\vec{E}_b. \tag{12}$$

The moment equilibrium is described by:

$$d(-M_t\vec{E}_t)/dS+frN\vec{E}_t=0. \tag{13}$$

Along the $\vec{E}_t$ direction, one has:

$$dM_t/dS=frN. \tag{14}$$

Along the $\vec{E}_n$ direction, equ. (13) implies:

$$M_tk_b=0.$$

This violates equilibrium, unless $k_b=0$. Furthermore, when any finite length of the drill string is taken as a free body, overall moment equilibrium is clearly violated in all directions, unless the borehole is straight.

To illustrate, FIG. 1 is a finite sement of the drill string with constant (2−) curvature $k_b$ subjected to torque $M_{t1}$ and $M_{t2}$ at both ends, and an assumed constant distributed torque, t, for ease of illustration. To consider moment equilibrium, one need not include all the forces acting on the free body, since there is in general no force couple. One can therefore consider moment equilibrium about a point on the line of action of the resultant total force.

Figure 2:
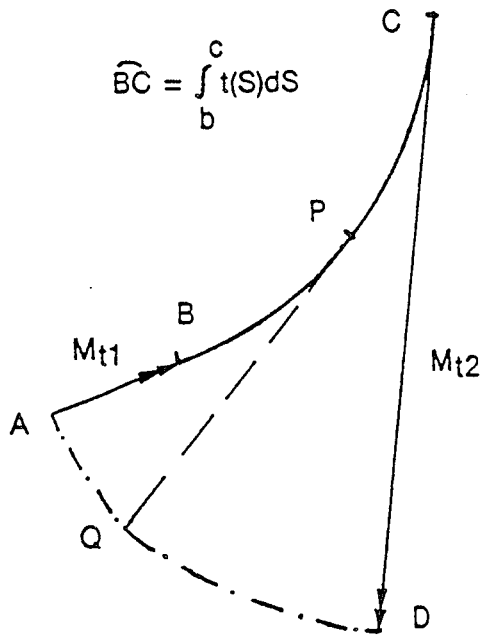
FIG. 2 is a vector diagram of the torsional moments acting on a portion of a drill string.

FIG. 2 is a geometric construction of the total moment acting on the free body by the applied torque. The straight lines AB and DC denote the torque at b and c, i.e., $M_{t1}$ and $M_{t2}$ respectively, whereas the curved (circular arc) section BC denotes the integration of the distributed torque t $\vec{E}$t. Note the following:

(a) Length CD=Length AB+arc length BC (from Equ. (14));

(b) Vector CD is tangent to arc BC at point C.

Similarly, for any point p within the section BC in FIG. 1, the corresponding torque is the vector PQ in FIG. 2, satisfying the above two conditions. Note that if t is not constant, then, the curve BC will not be a circular arc, but the above conditions still hold.

The above relationships can be interpreted as follows: The torque integrand curve APC is the "evolute" of the torque integral curve AQD, which in turn is the "involute" of APC.

Therefore, the total resultant moment for this section is the vector AD, and not zero. This implies that the section is not in moment equilibrium.

One can thus conclude that the soft-string model provides reasonably good estimates of the torque and drag under the following conditions:

(1) The drill string continuously contacts the borehole, i.e. the drill string centerline nearly coincides with the borehole centerline. This requires the borehole trajectory to be very smooth and contain few if any reversed curvatures. This is a major assumption and the source of significant error. It completely ignore the effect of hole clearance.

(2) The interpolated borehole trajectory between survey stations is smooth (at most linearly varying curvature) and has zero totuosity. In such situations the soft-string model does provide very good results within each such survey interval.

Rigorous Derivation of Constrained Drill String Model According to the Present Invention If we assume, as in the "soft-string" model, that the drill string is completely constrained by the borehole (resulting in continuous contact), but do not neglect the stiffness of the drill string, then a rigorous theory can be derived for computing the contact force, and the generated torque and drag.

Figure 3:
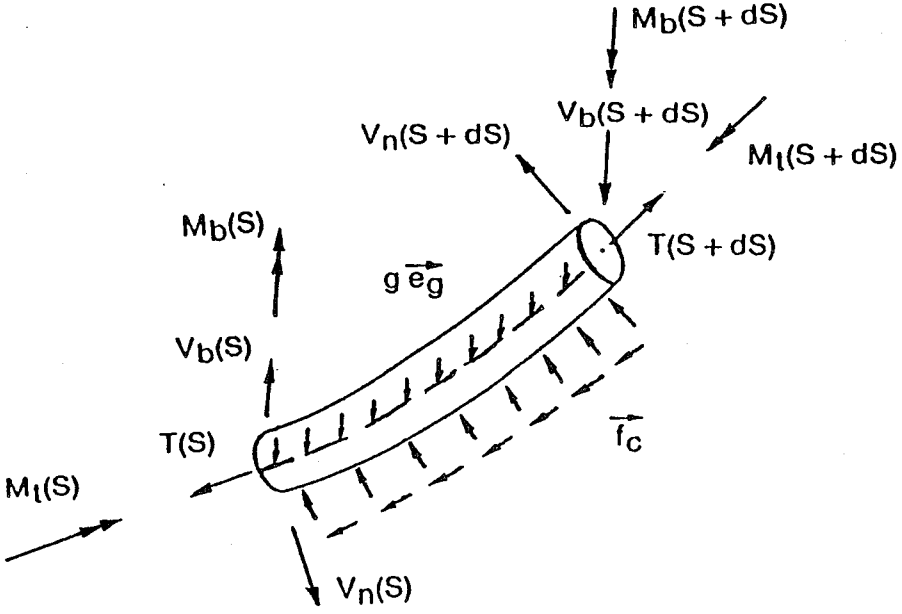
FIG. 3 is a pictorial illustration of the forces acting on a differential segment of a drill string while tripping out of a well.

The derivation is based on the large deformation formulation recently presented in the paper by the inventor referenced below, except that the natural coordinate system ($\vec{E}_t$, $\vec{E}_n$, $\vec{E}_b$) will be used instead. This is because the drill string is assumed to be completely constrained by the borehole, and therefore the centerline of the drill string has the same trajectory as that of the borehole. Equilibrium of the differential segment dS while tripping out is shown in FIG. 3:

$$d\vec{F}/dS + \vec{f_c} + g\,\vec{E_g} = 0; \tag{15}$$

$$d\vec{M}/dS + \vec{E_t}\,X\,F + t\,\vec{E_t} = 0; \tag{16}$$

where $$\vec{F} = \vec{V} + T\,\vec{E_t};\ \vec{V} = V_n\,\vec{E_n} + V_b\,\vec{E_b}; \tag{17}$$

$$\vec{M} = M_b\,\vec{E_b} - M_t\,\vec{E_t};$$

$$\vec{f_c} = -f\,N\,\vec{E_t} + \vec{N};$$

$$\vec{N} = N_n\,\vec{E_n} + N_b\,\vec{E_b};\ t = f\,r\,N;$$

and the resultant bending moment, $M_b$, is defined by the borehole's flexural curvature, $k_b$, by:

$$M_b = k_b * EI.$$

Noting that:

$$d\vec{A}/dS = d\vec{A}/dS + \vec{k_N}XA; \tag{18}$$

where $\vec{k}_N$ is the natural "total curvature" vector of the borehole:

$$\vec{k}_N = k_b\vec{E_b} + k_n\vec{E_t};$$

with $k_n$ being the tortuosity of the borehole centerline, we can obtain, the following four equilibrium equations:

(1) Moment equil. in $\vec{E}_t$ direction:

$$dM_t/ds = t;\ t = frN. \tag{19}$$

(2) Force equil. in $\vec{E}_t$ direction:

$$d/dS(T + M_b^2/(2EI)) - fN + g\vec{E_g} * \vec{E_t} = 0; \tag{20}$$

(3) Force equil. in $\vec{E}_n$ direction:

$$-d^2M_b/dS^2 + k_n(k_bM_t + k_nM_b) + TK_b + N_n + g\vec{E_g} * \vec{E_n} = 0;\ \text{and} \tag{21}$$

(4) Force equil. in $\vec{E}_b$ direction:

$$-d(k_bM_t + k_nM_b)/dS - k_n dM_b/dS + N_b + g\vec{E_g} * \vec{E_b} = 0. \tag{22}$$

One will note that each of these four equations are similar to equations set forth in the publication by the inventor entitled "General Formulation of Drill string Under Large Deformation and Its Use in BHA Analysis", SPE Ann. Tech. Conf., October 1986, New Orleans, SPE Paper #15562.

In addition, one has:

$$\vec{V} = dM_b/dS\vec{E_n} + (k_bM_t + k_nM_b)\vec{E_b}. \tag{23}$$

Note that the assumption of zero stiffness by the soft-string model implies $M_b = 0$. However, one cannot therefore assume zero shear force, as does the soft-string model, because of the term $k_bM_t$. This error will lead to incorrect normal contact force.

Several comments can be made:

(1) Comparing equation 21 to equation 8 in computing the normal component of the contact force $N_n$, one sees that the soft-string model as set forth in equation 8 misses the first two terms. Assuming planar curves (as is the case with most survey interpolation methods), then the tortuosity $k_n$ vanishes. Therefore, if the moment (or hole curvature) varies linearly, no error is involved. Otherwise, substantial error will occur in the estimate of $N_n$. Note that real boreholes do possess non-vanishing $k_n$.

(2) Comparing equation 22 and equation 9 in computing the binormal component of the contact force $N_b$, under the assumption of zero tortuosity, one sees that the soft-string model misses the terms:

$$k_b dM_t/dS + M_t dk_b/dS.$$

The second term vanishes if the circular arc method is used, but the first term is always present, being equal to:

$$N_b = -k_b * (frN).$$

When viewed from the entire borehole trajectory, one can appreciate the following problems with the soft-string model:

(1) The drill string centerline does not conform to that of the borehole, particularly if the borehole has reversed curvatures (local hole crookedness). This point will be amplified in the following section.

(2) Due to the above conditions, the drill string twist is different from the borehole tortuosity and not zero, and does contribute to the tortuosity of its centerline as discussed in the previously referenced publication by the inventor. Therefore significant error exists in the computation of the contact force N.

(3) For any finite length segment of the drill string, moment equilibrium is violated, as proven in FIGS. 1 and 2. The soft-string model, which ignores the physical components of the resultant force and the resultant bending moment, each shown in FIG. 3, is thus inherently inaccurate.

Methodology of the Present Invention

Contrasting the methodology described in the section immediately above, the actual drill string is not fully constrained. Therefore, the above methodology will tend to overestimate the torque and drag. The model of the present invention is derived from the governing equations set forth in SPE paper #15562, especially the fully non-linear equations (A-15 to A-22), and the simplified equations (A-23 to A-28). These equations are used to compute the displacements of the drill string from the centerline of the borehole, and permit the determination of the locations and the magnitudes of the contact forces between the drill string and the sidewall of the borehole. These contact forces, along with the transfer relations for torsional moment and axial force, permit more realistic computations of torque and drag.

Such an analysis method is commonly referred to as a BHA (bottomhole assembly) analysis, although such an analysis has not been previously used to compute torque and drag.

In a preferred embodiment, the improved torque-drag model program as set forth above combines two programs:

(1) A soft-string model program, TORDRA-O, coded with a very stable numerical integration technique, and (2) A BHA analysis program for the stiff collar section. This is modified from DIDRIL-I (a finite-difference based program using large deformation theory) to account for the drag generated while tripping.

This improved torque-drag program can handle top drives when the drill string is rotated while tripping. It is also being modified to allow the computation of stiffness effect in more than one segment of the drill string if needed. It currently contrains the following options:

(1) Soft-string analysis only, BHA analysis bypassed;

(2) Inverted BHA analysis, where the stiff collar section is not located near the "bit".

The program can be run in two modes: (1) Forward mode: given friction coefficient, to find surface loads; (2) Inverse mode: given surface load(s), to find friction coefficient(s).

It should be understood, of course, that other BHA (bottom-hole assembly) analysis programs and some predictive bit-rock interaction models may be used for taking into consideration the stiffness of the portion of the drill string. Examples of other BHA analysis program are described in the following publications: (1) Lubinski, A. and Woods, H. B.: "Factors Affecting the Angle of Inclination and Dog-legging in Rotary Bore Holes:, API Drilling & Prod. Pract., 1953, pp. 222–250; (2) Williamson, JK. S. and Lubinski, A.: "Predicting Bottomhole Assembly Performance", IADC/SPE Conf., paper #14764, Dallas, February 1986; (3) Millheim, K., Jordan, S. and Ritter, C. J.: "Bottom-hole Assembly Analysis Using the Finite Element Method", JPT, February 1978, pp. 265–274; and (4) Jogi, P. N., Burgess, T. M. and Bowling, J. P.: "Three-Dimensional Bottomhole Assembly Model Improves Directional Drilling" IADC/SPe Conf., paper #14768, Dallas, February 1986. Bit rock interaction models may also be used for considering stiffness of a portion of a drill string in a torque and drag analysis, and such models are described in the following additional publications: (1) Bradley, W. B.: "Factors Affecting the Control of Borehole Angle in Straight and Directional Wells", JPT, June 1973, pp. 679–688; (2) Millheim, K. K. and Warren, T. M.: "Side Cutting Characteristics of Rock Bits and Stabilizers While Drilling", SPE paper #7518, Fall Annual SPE Conf. 1978, p. 8; (3) Brett, J. F.; Gray, J. A.; Bell, R. K. and Dunbar, M. E.: "A Method of Modeling the Directional Behavior of Bottomhole Assemblies Including Those with Bent Subs and Downhole Motors", SPE/IADC conference, February 1986, Dallas SPE paper #14767; (4) Ho, H.-S.: "Discussion on: Predicting Bottomhole Assembly Performance by J. S. Williamson & A. Lubinski, SPE Drilling Engng. J., March 1987, pp. 37–46", SPE/DE, September 1987, pp. 283–284; and (5) Ho., H.-S.: "Prediction of Drilling Trajectory in Directional Wells Via a New Rock-Bit Interaction Model", SPE Paper #16658, Presented at SPE Conf., October 1987, Dallas.

Case Studies

The following theoretical case studies provide the basic rationale for the development of the torque and drag model according to the present invention, and clearly illustrate the shortcomings of the soft-string model.

Consider a situation where measurements at two adjacent survey stations show the borehole to be in a smooth trajectory, when in fact there exists local crookedness. This can arise when drilling through hard and soft formation sequences. The case studies illustrate that one can use torque-drag tripping logs to detect such local hole crookedness.

A. Comparison Of Tripout Tension Across A Step Kink

Figure 4:
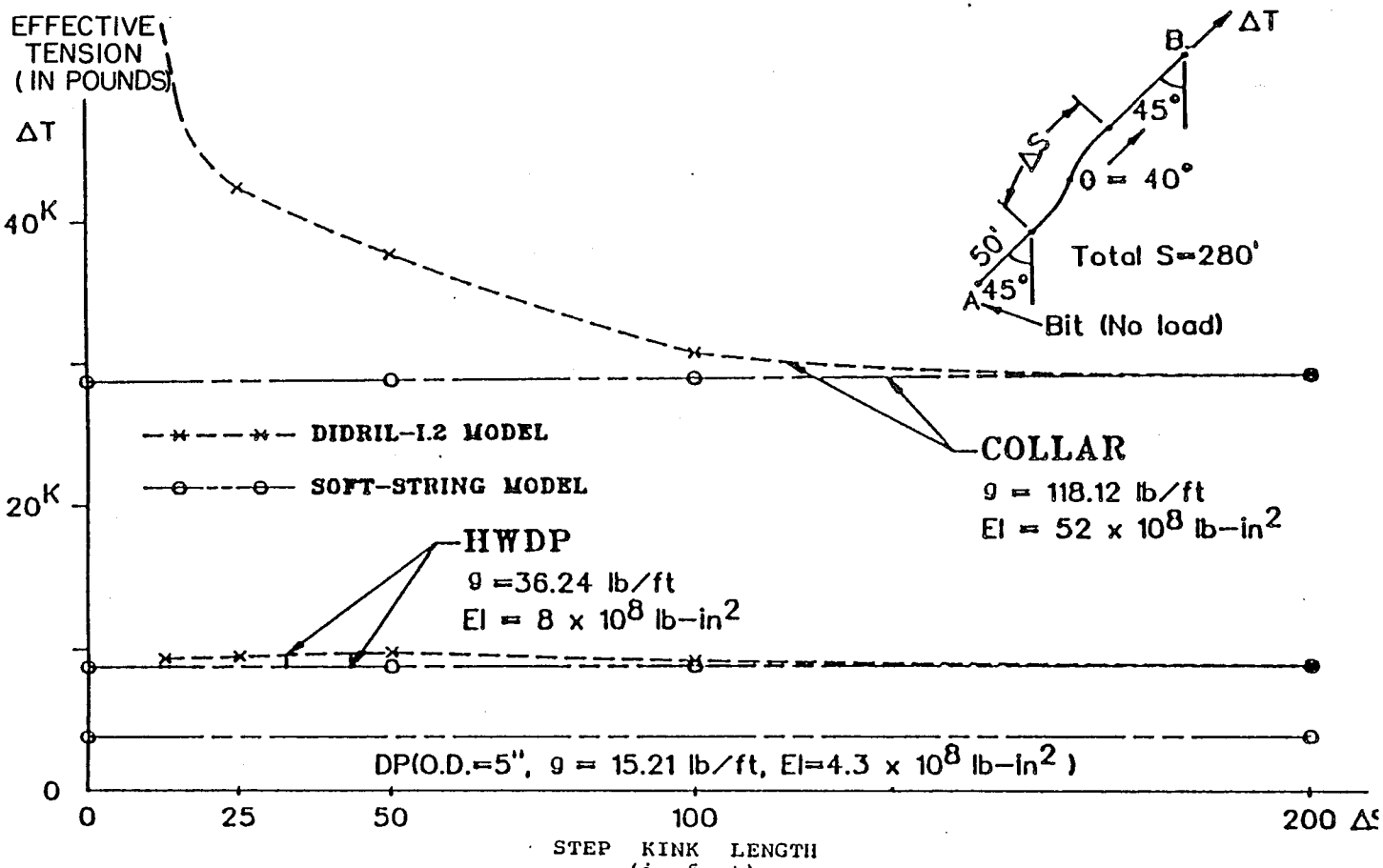
FIG. 4 is a graphic illustration of the effect of step kink length on drag for both the soft string model and the torque-drag model of the present invention, assuming a friction coefficient of 0.2.

First consider the situation where the local hole crookedness is a "step kink", shown in FIG. 4, embedded in a supposedly straight hole. Assume the bit to be at point A, tripping out. We examine the effective tension at point B, as a function of the length of the curved section of the well. The shorter the curved section (with the same total change in deviation angle), the more severe the local hole crookedness is. Intuitively this will lead to larger tension at point B. Results using the soft-string model are shown as dotted lines (for collar, HWDP, and drillpipes). They show clearly that the soft-string model is totally insensitive to such local hole crookedness.

FIG. 4 also shows results using the modified BHA program, designated as DIDRIL 1.2, using a similar make-up for collar, HWDP, and drillpipe. One can conclude:

(1) Stiffness effect is very significant in collar section when passing severe local hole crookedness. For example, when the curve section length is 50', tension at point B is about 8 kips greater than that computed from the soft-string model.

(2) Such effect lessens dramatically for HWDP, and is negligible for drillpipe.

B. Comparison of Trip-Out Tension Across A Down Kink

Figure 5:
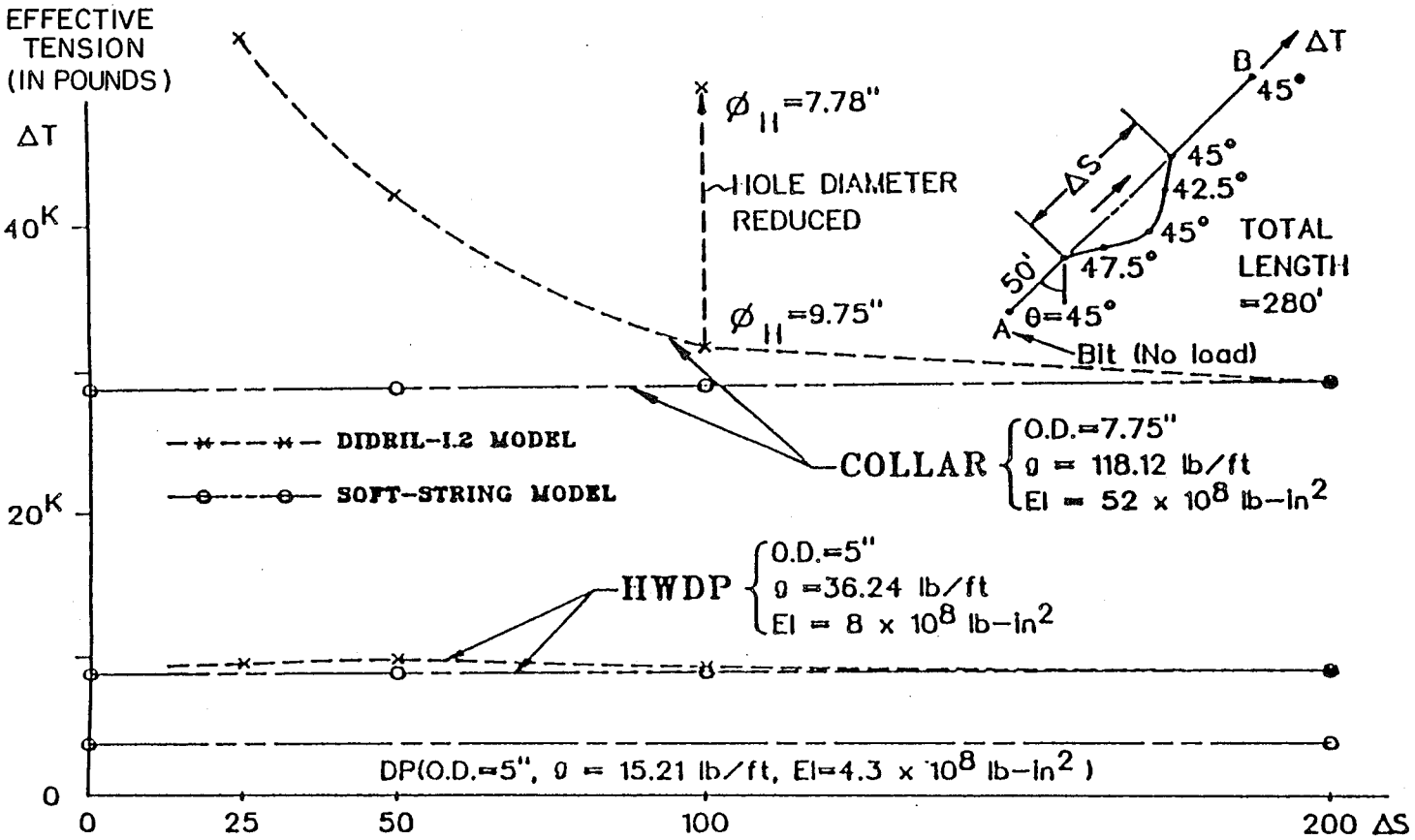
FIG. 5 is a graphic illustration of the effect of downkink length on drag for both the soft string model and the torque-drag model of the present invention, assuming a friction coefficient of 0.2.

This case study is similar to the one above, except the hole crookedness is now assumed to be a "down kink", as shown in FIG. 5. Results show entirely similar trends as in the previous case. When the curved section length is 50', difference in tension at point B is about 12 kips.

Furthermore, in FIG. 5, when borehole clearance is reduced for the curved length at 100', the improved model shows dramatic increase in the effective tension at point B, whereas the soft-string model remains unchanged, since the soft-string model is independent of the borehole diameter.

Application and Modifications of the Methodology of the Invention

According to the method of the present invention, a torque and/or drag log is generated, typically by charting on paper or other tangible and reproduceable medium, the predicted torque or drag of a drill string as a function of the depth of the drill string in the directional oil or gas well. This torque, drag, or torque and drag log may also illustrate visually the location of certain key downhole components in the well and along the drill string, such as the bit, the collar section of the drill string, centralizers, drilling jars, stabilizers, etc., and provide a graphic output of the torque or drag load generated by contact between the borehole and the drill string at each of these components. Moreover, the log may graphically depict the path of the well, the path of the drill string in the well, and the total torque and/or drag for these key components along the drill string at specific locations in the well. The information learned, such as the calculated radial position of any portion of the drill string in the well, may be particularly useful to conducting effective completion, workover, or cementing operations within the well.

A specific method of utilizing a typical torque-drag log according to the present invention comprises the following steps, performed in sequence:

(1) The drill string's actual or measured torque and axial load conditions are recorded, measured at the surface and, if desired, downhole. Surface torque measurements may, for example, be taken as a function of the variable load on the electric motor which drives the rotary table for the drill string. Drag may be inferred from axial (hook) load measurements using a sensor attached to the deadline, or by other hookload measurement devices. These actual torque and/or drag measurements are carried out both while tripping in and tripping out of the well, and while rotating or drilling.

(2) A first sequence of torque-drag logs labeled for measurements taken while drilling, rotating, or tripping into or out of the well may be established, plotting the actual or measured data as a function of the depth of the well.

(3) Survey data, preferably of the MWD variety, may be recorded to indicate the trajectory of the well bore.

(4) An average coefficient of friction for the entire well path may be computed using the torque-drag model of the present invention. Alternatively, the coefficient of friction may be calculated for any selected depth region or zone, and under trip in, trip out, rotating and/or drilling conditions.

(5) Assuming that the coefficient of friction does not change, the incremental torque and drag between depth D and D+dD may then be calculated by the use of the torque-drag analysis according to the model of the present invention.

(6) If the torque-drag analysis shows a significantly different incremental torque or drag than the actual (measured) data, one may assume a condition which is at variance from those assumed in the initial model, such as an undetected change in borehole trajectory or the borehole geometry. One may then iterate, typically by a computer program, until data agreement is reached between the calculated torque and/or drag data according to the revised model (including variance) and the actual torque and/or drag measurements, thereby verifying the assumption regarding the variance from the initial model. If the data do not converge (or do converge but only under unrealistic variance conditions), a revised variance would normally be assumed and the iterative process repeated.

Logs generated by the model of the present invention thus generally assist in verifying certain mechanical or geometric conditions of the borehole, by matching survey measurements and downhole and/or surface measurements with the output from the model. The torque-drag logs can also be used in combination with a torque-drag model to analyze the incremental torque-drag. Deviations from the assumed conditions can be detected, and this information used, for example, to alert an operator of potential directional drilling problems.

According to the torque-drag analysis of the present invention, the magnitude of the contact force on each incremental portion of the drill string is determined as a function of the trajectory of the well, the clearance of the drill string and its adjacent portion of the well (borehole clearance or geometry), and the stiffness (modulus of elasticity) of that portion of the drill string. This analysis preferably takes into consideration all of the kinematic forces acting on that portion of the drill string, e.g., displacement of the drill string from the centerline of the borehole, the deformation (strain) of that portion of the drill string, etc. Also, all external forces acting on that portion of the drill string may be determined, such as contact forces, weight of the drill string, torque on the bit, fluid forces, etc. Finally, the internal forces are also calculated and taken into consideration, such as axial forces and bending moments. The axial force and torsional moment equilibrium conditions for incremental portions of the drill string are determined. The full range of static and dynamic forces on the drill string which would influence the magnitude and location of the torque or drag on that portion of the drill string generated by the contact between the drill string and the borehole may thus be determined. It should be understood that this determination of the location and magnitude of the forces may result from contact between the drill string and either the sidewalls of the formation (if open hole) or the internal surface of the casing (if closed hole). Typically this analysis may be made for at least the collar portion the the drill string, since the case studies previously presented illustrate that this is the portion of the drill string which most drastically effects the torque and/or drag if located in a step kink or down-kink portion of the well bore. It should be understood, however, that this same analysis may be performed for the HWDP or regular drill pipe sections of the drill string. Also, the collar section will typically be provided just above the drill bit, but may be located higher in the drill string, in which case an inverted BHA analysis may be conducted.

According to one modification of the methodology described above, the torque-drag model of the present invention may be used to detect a change in borehole shape or geometry due to repeated tripping operations or due to washouts. According to this procedure, time-lapsed torque-drag logs may be generated for each tripping operation, either into or out of the well. The model of the present invention may be used to analyze changes in the logs, and this analysis may verify an assumed change in borehole geometry caused by the repeated tripping operations.

As a further modification, the coefficient of friction for any depth zone of the well may be presumed to be constant whether tripping in or tripping out of the well. The measured torque and drag while tripping in may be compared to the calculated torque and drag according to the model, and the measured torque and drag while tripping out similarly compared the calculated values. The coefficient of friction may be changed for analysis by both the trip in and trip out conditions until the variance between the measured and calculated data is minimized. The coefficient of friction resulting in this minimized variance may be presumed to be the actual coefficient of friction. Also, coefficients of friction may be calculated by the above procedure for selected zones of the well, resulting in a more accurate analysis of well conditions.

A comprehensive drilling program including the torque-drag analysis described, may therefore address the following issues in an integral manner: (1) planning, prediction and/or control of the well path, (2) avoidance, prediction or advisory action with respect to drilling troubles, and (3) total cost minimization for the entire well. Analysis according to the present invention enables unwanted deviations in the drilling trajectory to be better understood, and the operator may thus plan for them, if possible, and monitor and count for their effects on the drilling operation. Conventional well path planning may be expanded by the present invention to include the anticipated deviation caused by the collar section of the tubing string and the formation, the generated torque and drag, and the ensuing implications to drill string or casing design requirements. Improved control and predictive capabilities provided by the present invention should result in fewer corrective actions to maintain proper well trajectory, thereby achieving major cost savings.

Issue (2) deals with the many potential problems which become more acute and more difficult to resolve when drilling directional wells, such as fluid pressure control (kick or loss circulation), insufficient cuttings transport and hole cleaning, drill string failure, and severe hole crookedness. The present invention enables the operator to better understand the causes of these troubles, and to develop capabilities to monitor, interpret, control and predict them.

Issue (3) concerns the optimization of the total cost of the entire well, by considering trade-offs between conflicting governing parameters. This task is again considerably more difficult in direction drilling, since more parameters are present. The torque-drag analysis method of the present invention enables better understanding of the effect of variation each parameter has on the overall drilling cost. An example of such a trade-off is the choice of drilling mud. Lubricated muds can reduce borehole friction, but are much more expensive and difficult to dispose, while the water-based muds are cheaper but will cause higher torque and drag. These costs may thus be better optimized with due consideration to the information gained as a result of the analysis conducted by the present invention.

Those skilled in the art will appreciate that this same torque-drag analysis may be used for predicting conditions of deep vertical wells rather than inclined wells. Spiraling of a deep vertical well can result in severe torque and drag, so that vertical wells with spiraling tendencies should be analyzed and handled as directional wells.

The torque-drag analysis method of the present invention may also be used to generate a model for analyzing torque and/or drag on casing. Casing typically used in an oil or gas well has significant stiffness, and more importantly, it has much smaller borehole clearance than the drill string. The model of the present invention takes this stiffness into consideration when comparing the actual torque-drag data to that generated by the model. Since the borehole clearance between the casing and the drilled formation will typically be less in the deeper portions of the well where the borehole diameter is reduced, the torque-drag analysis may only be conducted for a selected lower portion of the casing, rather than for the entire length of casing. The trajectory of the borehole may thus be redefined (changes detected in the borehole trajectory) from data obtained while running in, running out, and/or rotating casing.

The torque-drag analysis of the present invention is thus a significant step toward providing a true predictive directional drilling program that can be used both in the office as a planning aid, and in the field as a monitoring and advisory tool. By coupling an overall predictive drilling program with a trouble analysis program which accounts for the affects of the deviation on torque and drag, basic elements of a directional drilling simulator are provided that will effectively enable one to drill a well on a computer.

Although the techniques and methods of the present invention have been described in terms of specific embodiments, it should be understood that this is by illustration only, and that the invention is not necessarily limited thereto. Other alternate embodiments and variations in operating techniques will be readily apparent to those skilled in the art in view of this disclosure. Accordingly, further modifications and variations are contemplated which may be made without departing from the spirit and scope of the invention.

What is claimed is:

1. A method of generating an improved torque or drag log for a drill string in a directionl oil or gas well passing through earth formations, the method comprising the steps of:

(1) recording data indicative of a presumed borehole trajectory of the directional well;

(2) calculating drill string stiffness of at least a portion of the drill string;

(3) determining contact locations between the portion of the drill string and side walls of the well as a function of the calculated drill string stiffness and the presumed borehole trajectory;

(4) calculating the magnitude and radial direction of the contact force between the sidewalls of the well and the drill string at each of the determined contact locations;

(5) calculating the magnitude of torque or drag on the portion of the drill string from the calculated contact forces; and (6 ) depicting the calculated torque or drag as a function of the depth of the well.

2. The method as defined in claim 1, wherein the portion of the drill string includes the collar section of the drill string.

3. The method as defined in claim 1, wherein step (5) includes the step of assuming a coefficient of friction between the drill string and the sidewalls of the well.

4. The method as defined in claim 3, wherein the coefficient of friction is assumed for a selected depth zone of the well.

5. The method as defined in claim 1, wherein step (3) includes the step of determining the contact locations as a function of clearance between the drill string and the sidewalls of the well.

6. The method as defined in claim 2, wherein the determination of the contact locations is made as a function of axial placement or one or more stabilizers on the collar section of the drill string.

7. The method as defined in claim 1, wherein step (3) includes the step of calculating kinematic, external, and internal forces acting on at least the portion of the drill string.

8. The method as defined in claim 1, wherein step (3) includes the step of determining axial force and torsional moment equilibrium conditions on at least the portion of the drill string.

9. The method as defined in claim 2, wherein the portion of the drill string further includes the HWDP section of the drill string.

10. The method of redefining a borehole trajectory in a directional oil or gas well passing through earth formations from an assumed borehole trajectory interpolated from survey data, comprising the steps of:

(1) measuring torque and/or drag data on a drill string in the directional well;

(2) generating a first torque and/or drag log from the measured data recorded as a function of the incremental depth of the drill string;

(3) calculating the torque and/or drag at incremental portions of the drill string as a function of the calculated drill string stiffness and the assumed borehole trajectory for the incremental portions of the drill string;

(4) generating a second torque and/or drag log from the calculated torque and/or drag recorded as a function of the incremental depth of the drill string in the directional well; and (5) comparing the first and second logs to redefine the borehole trajectory from the assumed borehole trajectory.

11. The method as defined in claim 10, wherein step (3) comprises:

determining contact locations between the drill string and sidewalls of the well; and calculating the magnitude of the contact force between the sidewalls of the well and the drill string at each of the determined contact locations.

12. The method as defined in claim 10, wherein step (3) includes the step of determining a coefficient of friction between the drill string and the sidewalls of the well.

13. The method as defined in claim 12, wherein the coefficient of friction is determined for a selected depth zone of the well.

14. The method as defined in claim 11, wherein the contact location are determined as a function of clearance between the drill sring and the sidewalls of the well.

15. The method as defined in claim 10, wherein step (3) includes the step of calculating kinematic, external, and internal forces acting on the drill string.

16. The method as defined in claim 10, wherein step (3) includes the step of determining axial force and torsional moment equilibrium conditions acting on the drill string.

17. The method as defined in claim 10, wherein the torque and/or drag on the drill string is measured at the surface of the well.

18. The method as defined in claim 10, wherein the torque and/or drag on the drill string is measured both while the drill string is tripping into and tripping out of the well.

19. The method as defined in claim 10, wherein the torque and/or drag on the drill string is measured while rotating the drilling string in the well.

20. The method as defined in claim 10, wherein step (5) includes the step of minimizing variations between the first and second logs to redefine the borehole trajectory.

21. The method of calculating the coefficient of friction between a tubular string and sidewalls of a borehole of a directional oil or gas well passing through earth formations, comprising the steps of:

(1) measuring torque and/or drag data on a drill string in the directional well;

(2) generating a first torque and/or drag log from the measured data recorded as a function of the incremental depth of the drill string;

(3) determining contact locations between the drill string and sidewalls of the well; and (4) calculating the magnitude of the contact force between the sidewalls of the well and the drill string at each of the determined contact locations; and (5) computing the coefficient of friction as a function of data measured in step (1) and the magnitude of the contact forces calculated in step (4 ).

22. A method as defined in claim 21, wherein step (3) includes the step of determining the contact locations as a function of clearance between the drill string and the sidewalls of the well.

23. A method as defined in claim 22, wherein the determination of the contact locations is made as a function of axial placement of downhole components on a collar section of the drill string.

24. A method as defined in claim 21, wherein steps (1), (4) and (5) are each performed for conditions indicative of tripping the tubular string both into and out of the well.

25. A method of redefining the cross-sectional geometry of a directional oil or gas well borehole passing through earth formations, comprising the steps of:

(1) measuring at the surface of the well torque or drag data between a tubular string in the well and sidewalls of the borehole;

(2) recording the measured torque or drag data as a function of the incremental depth of the well;

(3) measuring data indicative of the trajectory of the well;

(4) recording the measured well trajectory data as a function of the incremental depth of the well;

(5) calculating the drill string stiffness of at least a portion of the tubular string;

(6) determining contact locations between the portion of the tubular string and the sidewalls of the borehole as a function of the calculated drill string stiffness and the measured data indicative of the trajectory of the well;

(7) calculating the magnitude of the contact force between the sidewalls of the borehole and the drill string at each of the determined contact locations; and (8) determining the coefficient of friction between the tubular string and sidewalls of the borehole as a function of the calculated contact forces and the measured torque or drag data.

26. The method as defined in claim 25, wherein step (6) is determined as a function of axial placement of downhole components on at least a section of the tubular string.

27. The method as defined in claim 25, wherein step (6) includes the step of calculating kinematic, external, and internal forces acting on at least a section of the tubular string.

28. The method as defined in claim 25, wherein step (6) includes the step of determining axial force and torsional moment equilibrium conditions on at least a section of the tubular string.

29. The method as defined in claim 25, wherein step (1) is performed both while tripping the tubular string both into and out of the well.

30. The method as defined in claim 25, wherein steps (1) and (2) are performed at various time intervals to determine the change in the cross-sectional geometry of the well over a period of time.

31. The method as defined in claim 25, wherein step (8) is performed for one or more selected depth zone of the well.

32. A method of generating an improved torque or drag log for a casing string in a directional oil or gas well passing through earth formations, the method comprising the steps of:

(1) calculating casing stiffness of at least a portion of the casing string;

(2) determining contact locations between the portion of the casing and side walls of the well as a function of the calculated casing stiffness and a presumed borehole trajectory;

(3) calculating the magnitude and radial direction of the contact force between the sidewalls of the well and the casing at each of the determined contact locations;

(4) calculating the magnitude of torque or drag on the portion of the casing from the calculated contact forces; and (5 ) depicting the calculated torque or drag as a function of the depth of the well.

33. The well as defined in claim 32, wherein the portion of the casing is the lowermost portion of the casing in the well.

34. The method as defined in claim 32, wherein step (4) includes the step of assuming a coefficient of friction between the casing and the sidewalls of the well.

35. The method as defined in claim 32, wherein step (2) includes the step of determining the contact locations as a function of clearance between the casing and the sidewalls of the well.

36. The method as defined in claim 32, wherein step (2) includes the step of calculating kinematic, external, and internal forces acting on at least the portion of the casing.

37. The method as defined in claim 32, wherein step (2) includes the step of determining axial force and torsional moment equilibrium conditions on at least the portion of the casing.

38. The method as defined in claim 32, wherein the torque and/or drag on the casing is measured at the surface of the well.

* * * * *